US005230573A

United States Patent [19]

Yasuoka et al.

[11] Patent Number: 5,230,573

[45] Date of Patent: Jul. 27, 1993

[54] PRINTER WITH UPSTREAM SENSOR USED TO DETERMINE PAPER EMPTY CONDITION

[75] Inventors: Tadashi Yasuoka; Yuji Hasegawa, both of Tokyo, Japan

[73] Assignee: Seikosha Co., Ltd., Tokyo, Japan

[21] Appl. No.: 889,229

[22] Filed: May 27, 1992

[30] Foreign Application Priority Data

Jul. 19, 1991 [JP] Japan ..... 3-179784

[51] Int. Cl.[5] ..... B41J 29/38

[52] U.S. Cl. ..... 400/54; 400/708; 400/711; 400/712

[58] Field of Search ..... 400/608, 708, 708.1, 400/706, 54, 624, 625, 629, 630, 631, 634, 636, 711, 712; 271/110

[56] References Cited

U.S. PATENT DOCUMENTS

| | | | |
|---|---|---|---|
| 4,268,021 | 5/1981 | Rutishauser et al. | 400/625 |
| 4,671,683 | 6/1987 | Veno et al. | 400/706 |
| 4,727,437 | 2/1988 | Mizoguchi | 400/708 |
| 4,755,834 | 7/1988 | Kunimitsu et al. | 400/708 |
| 4,834,568 | 5/1989 | Kagami et al. | 400/708 |

FOREIGN PATENT DOCUMENTS

| | | | |
|---|---|---|---|
| 0025481 | 3/1981 | Japan | 400/708 |
| 0055279 | 4/1983 | Japan | 400/708 |
| 0025862 | 2/1986 | Japan | 400/708 |
| 0158485 | 7/1986 | Japan | 400/708 |
| 0074847 | 4/1988 | Japan | 400/708 |
| 0112185 | 5/1988 | Japan | 400/708 |

*Primary Examiner*—Eugene H. Eickholt
*Attorney, Agent, or Firm*—Jordan and Hamburg

[57] ABSTRACT

A printer improved in the accuracy of detection as to whether or not recording paper exists. The printer has a sensor provided upstream a printing head in a paper feed direction to detect whether or not recording paper exists, a device for measuring a paper feed quantity of the recording paper, a central processing unit that controls the measuring device and a printer control circuit, and a comparator that makes a comparison between the measured paper feed quantity and a predetermined value. When "paper empty" is detected by the sensor, the central processing unit judges it to be "real paper empty" when no "paper existence" is detected during the period that predetermined paper feed is conducted after the detection of the "paper empty", and then suspends the printing operation. Thus, it is possible to prevent the central processing unit from erroneously judging a printed portion of the recording paper to be the trailing end of the recording paper.

4 Claims, 3 Drawing Sheets

PRINTER WITH UPSTREAM SENSOR USED TO DETERMINE PAPER EMPTY CONDITION

BACKGROUND OF THE INVENTION

1. Field of the Invention

The present invention relates to a printer.

2. Description of the Prior Art

In a typical conventional printer, a reflection type photosensor is provided at the upstream side of a printing head. The photosensor faces a platen across paper.

A central processing unit receives an output voltage from the photosensor, and if the voltage is higher than a predetermined value, the central processing unit judges that paper exists (hereinafter referred to as "paper existence"), whereas, if the voltage is lower than the predetermined value, the central processing unit judges that no paper exists (hereinafter referred to as "paper empty").

After the trailing end of the recording paper has passed the photosensor, the photosensor comes to face the black platen, so that the output voltage from the photosensor becomes lower than the standard value. In consequence, the central processing unit judges that no paper exists, and suspends the printing operation after a predetermined period of time has passed. In addition, the central processing unit causes the recording paper to be discharged to the outside of the printer.

In the above-described printer, when recording paper having a printed portion is fed, the photosensor may face the printed portion of the recording paper. If such occurs, the central processing unit may malfunction such that even if the trailing end of the recording paper has not yet passed the photosensor, the central processing unit misjudges that no paper exists, and even during printing, it suspends the printing operation and discharges the recording paper to the outside of the printer.

SUMMARY OF THE INVENTION

Under the above-described circumstances, it is an object of the present invention to provide a printer which is improved in the accuracy of detection as to whether recording paper exists or not.

To this end, the present invention provides a printer comprising a sensor provided upstream a printing head in a paper feed direction to detect whether or not recording paper exists, means for measuring a paper feed quantity of the recording paper, a central processing unit that controls the measuring means and a printer control circuit, and a comparator that makes a comparison between the measured paper feed quantity and a predetermined value, wherein when "paper empty" is detected by the sensor, the central processing unit judges it to be "real paper empty" when no "paper existence" is detected during the period that predetermined paper feed is conducted after the detection of the "paper empty", and then suspends the printing operation.

The printer may be provided with an indicating device that is activated when the central processing unit judges "paper empty" to be "real paper empty".

According to the present invention, when "paper empty" is detected by the sensor, the central processing unit judges it to be "real paper empty" when no "paper existence" is detected during the period that predetermined paper feed is conducted after the detection of the "paper empty", and then suspends the printing operation.

Thus, it is possible to prevent the central processing unit from erroneously judging a printed portion of the recording paper to be the trailing end of the recording paper, and hence possible to improve the accuracy of detection as to whether or not recording paper exists.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and of which.

DETAILED DESCRIPTION OF THE PREFERRED EMBODIMENTS

One embodiment of the present invention will be described below in detail with reference to the accompanying drawings.

Figure 1:
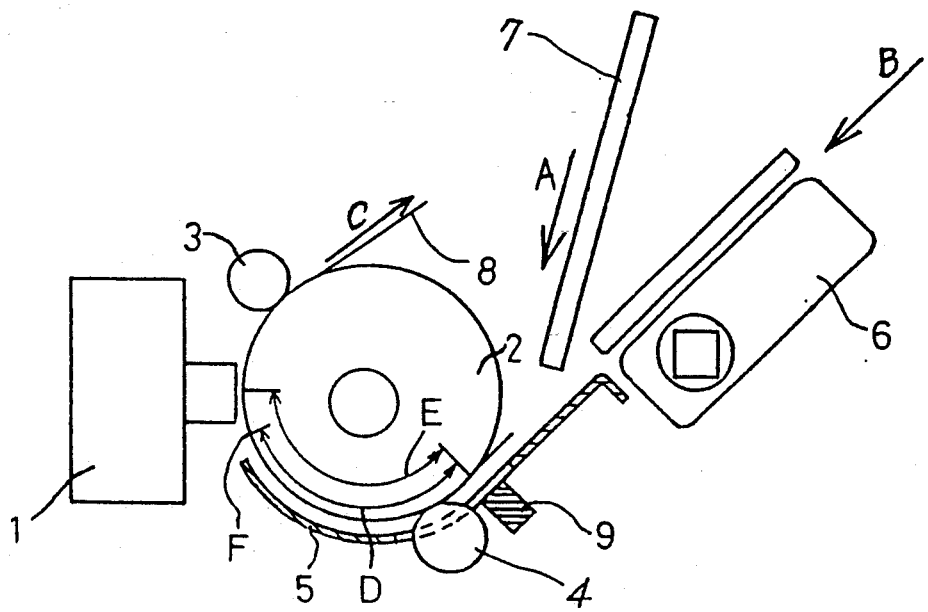
FIG. 1 is a side view of one embodiment of the printer according to the present invention.

The paper feed mechanism and printing mechanism of the printer according to the present invention are as follows:

As shown in FIG. 1, the printer has a printing head 1 and a platen 2 which faces it. Pinch rollers 3 and 4 are placed in resilient contact with the outer periphery of the platen 2 at respective positions which are downstream and upstream the printing head 1, respectively, in the paper feed direction. A paper guide 5 is provided under the platen 2.

A pin feed tractor 6 is provided upstream the paper guide 5 in the paper feed direction to feed fan fold paper toward the printing head 1 (i.e., the direction of the arrow B). A guide 7 is provided above the pin feed tractor 6 to guide cut paper toward the printing head 1 (i.e., the direction of the arrow A).

A reflection type photosensor 9 is provided on the paper guide 5 at a position upstream the pinch roller 4 in the paper feed direction such that the photosensor 9 faces the platen 2 across recording paper 8.

The photosensor 9 outputs a voltage in response to the reflected light from an object of detection.

Figure 3:
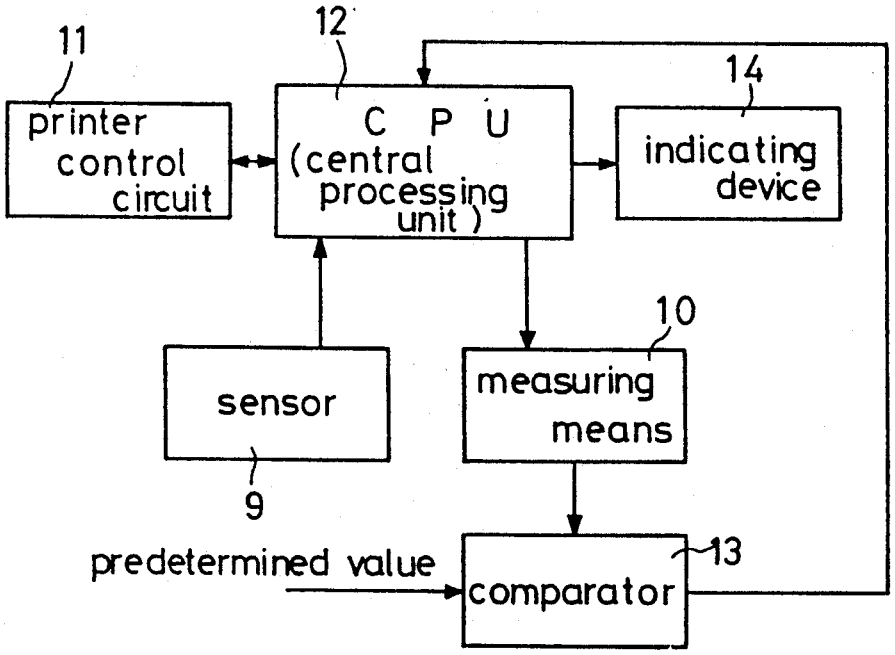
FIG. 3 is a block diagram of the embodiment of the present invention.

As shown in FIG. 3, the printer of the present invention has, in addition to the above-described arrangement, a means 10 for measuring a paper feed quantity, a central processing unit 12 that controls the measuring means 10, a printer control circuit 11, a comparator 13 that makes a comparison between the paper feed quantity and a predetermined value D, and an indicating device 14 that is activated when the central processing unit 12 declares "real paper empty".

The predetermined value D for the paper feed quantity is preferably set at a relatively large value in order to enable the photosensor 9 to detect "paper existence" effectively. However, the value D is set so that it does not exceed the length of path E of the recording paper 8 from the photosensor 9 to the printing head 1, as shown in FIG. 1.

Figure 2:
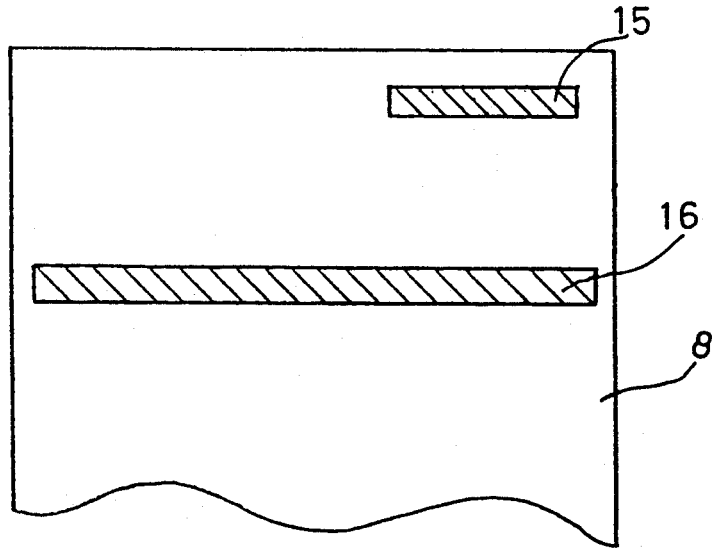
FIG. 2 is a side view of recording paper employed in the embodiment of the present invention.

Referring to FIG. 2, the recording paper 8 has printed portions 15 and 16, which may be a letterhead, e.g., a firm name, logotype, etc., a fixed format and so forth.

In FIG. 1, the side of the recording paper 8 which is printed with the portions 15 and 16 faces the printing head 1.

Figure 4:
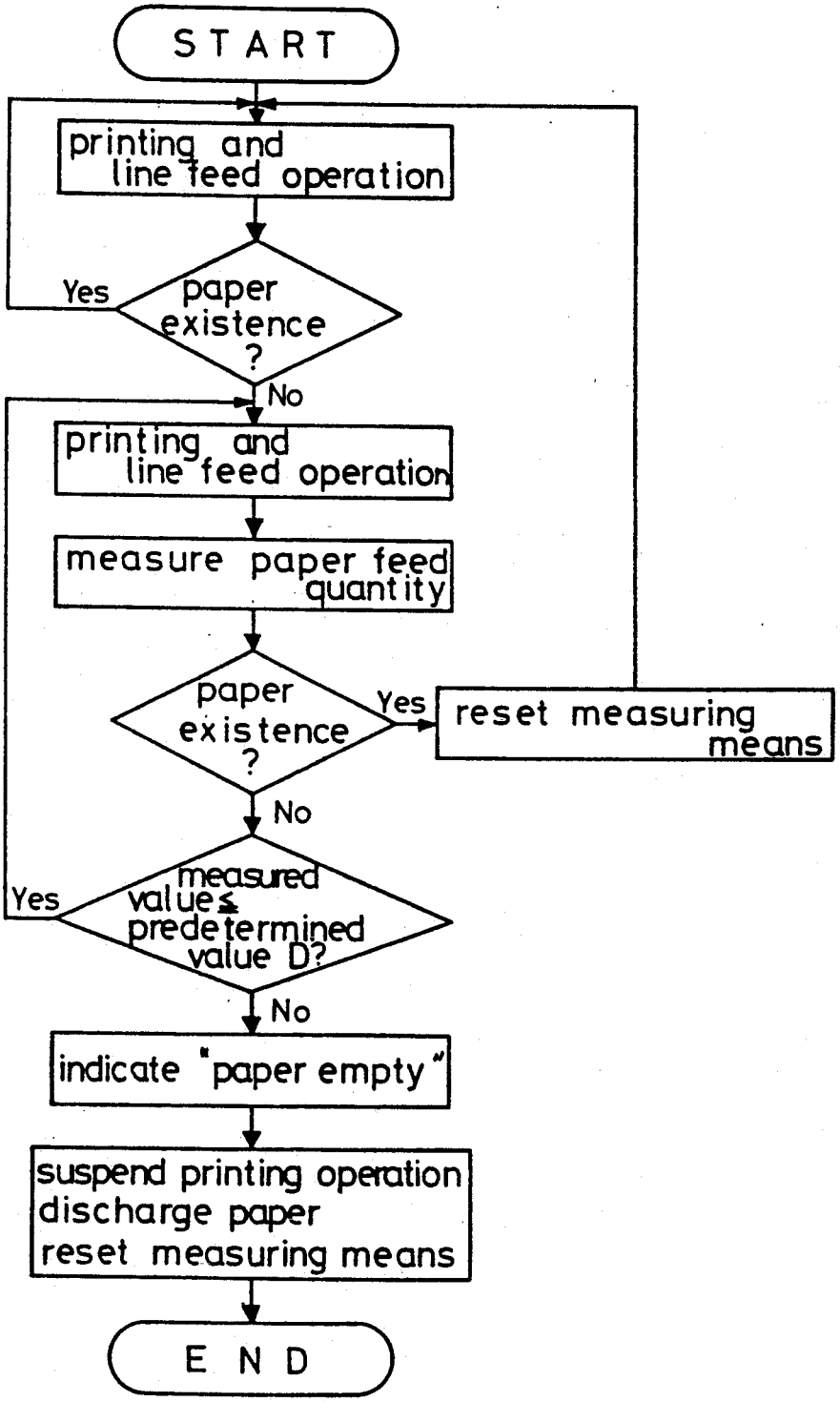
FIG. 4 is a flowchart showing the operation of the embodiment of the present invention.

The operation of the present invention will next be explained with reference to the flowchart of FIG. 4.

The recording paper (cut paper) 8 is fed from the guide 7 in the direction of the arrow A and enters the area between the platen 2 and the pinch roller 4. As the platen 2 rotates, the paper 8 is wound around the platen 2, passed through the area between the platen 2 and the pinch roller 3 and thus set in a state where a part of the paper 8 faces the printing head 1.

Then, the printing head 1 moves in a direction parallel to the longitudinal direction of the platen 2; while doing so, the printing head 1 effects printing on the recording paper 8. Then, the platen 2 rotates to feed the recording paper 8 in the direction of the arrow C in FIG. 1, thereby effecting line feed.

The photosensor 9 always checks whether or not paper exists. As long as the voltage output from the photosensor 9 in response to the reflected light is higher than the standard value and thus "paper existence" is detected by the photosensor 9, the central processing unit 12 continues the printing and line feed operations. When the output voltage from the photosensor 9 becomes lower than the standard value, "paper empty" is detected by the photosensor 9, and it outputs the detection signal to the central processing unit 12.

In response to the signal, the central processing unit 12, while continuing the printing and line feed operations, activates the measuring means 10 to start measurement of the paper feed quantity. In the meantime, the photosensor 9 continues checking whether or not the recording paper 8 exists, and the comparator 13 makes a comparison between the measured value of the paper feed quantity and the predetermined value D.

When the output voltage from the photosensor 9 becomes higher than the standard value thereafter, "paper existence" is detected by the photosensor 9, and it outputs the detection signal to the central processing unit 12. In response to this, the central processing unit 12 judges that the recording paper 8 still exists, and resets the measured value on the measuring means 10, thus allowing the printer to continue the printing and line feed operations.

That is, in this case, "paper empty" that was first detected by the photosensor 9 was erroneous, which means that the photosensor 9 detected the printed portion 15 or 16 of the recording paper 8 and declared "paper empty".

On the other hand, when the output voltage from the photosensor 9 is still lower than the standard value and thus "paper empty" is detected by the photosensor 9, the photosensor 9 keeps checking whether or not paper exists until the measured value by the measuring means 10 exceeds the predetermined value D. The central processing unit 12 judges "real paper empty" to be true only when "paper empty" is continuously detected by the photosensor 9 until the measured value exceeds the predetermined value D, and the central processing unit 12 then controls the indicating device 14 so as to indicate "paper empty" and suspends the printing operation.

That is, in this case, "paper empty" means that the trailing end of the recording paper 8 has actually passed the photosensor 9. During the period of time from the instant the trailing end of the recording paper 8 has passed the photosensor 8 until the printing operation is suspended, the recording paper 8 is fed by a length equal to the predetermined value D.

Since D is smaller than E, when the printing operation is suspended in FIG. 1, the trailing end of the recording paper 8 is at the position F which is short of the position of the printing head 1. Accordingly, there is no possibility that the printing head 1 will strike the platen 2 with no recording paper 8 placed thereon in a printing operation. It is therefore possible to prevent the printing data in the buffer from disappearing without being recorded on the recording paper 8.

Thereafter, the central processing unit 12 discharges the recording paper 8 to the outside of the printer and resets the measured value on the measuring means 10, and the printer ends the operation.

It should be noted that it is possible to use a device that indicates "paper empty" by sound as the indicating device 14.

It should also be noted that the arrangement of the printer and the recording paper fed are not necessarily limited to those in the foregoing embodiment.

According to the present invention, when "paper empty" is detected by the sensor, the central processing unit judges it to be "real paper empty" when no "paper existence" is detected during the period that predetermined paper feed is conducted after the detection of the "paper empty", and then suspends the printing operation.

Thus, it is possible to prevent the central processing unit from erroneously judging a printed portion of the recording paper to be the trailing end of the recording paper, and hence possible to improve the accuracy of detection as to whether or not recording paper exists.

Although the present invention has been described through specific terms, it should be noted here that the described embodiment is not necessarily exclusive and that various changes and modifications may be imparted thereto without departing from the scope of the invention which is limited solely by the appended claims.

What is claimed is:

1. A printer comprising:

a sensor positioned to detect whether or not recording paper exists at a position a first predetermined distance upstream of a printing head along a paper feed path in a paper feed direction;

means for measuring the distance said recording paper is fed in said direction;

a central processing unit connected to control said measuring means and a printer control circuit; and a comparator connected to compare the distance said paper is fed along said path with a second predetermined distance that no greater than said first predetermined distance;

wherein said central processing unit comprises means responsive to sensing by said sensor of an absence of paper at said position for a period during which said paper is fed for said second predetermined distance following said sensing of said absence of said paper for determining a "real paper empty" condition and suspending operation of said printer.

2. A printer according to claim 1, further comprising an indicating device that is activated when said central processing unit determines the occurrence of a "real paper empty condition".

3. A printer comprising a print head;

a sensor at a position a first predetermined distance upstream of said printing head in a paper feed direction, along a paper feed path, for sensing the present or absence of paper at said position;

means for measuring the length of paper fed along said path in said direction; and a central processing unit, said central processing unit comprising means for stopping operation of said printer in response to sensing of the absence of paper at said position, by said sensor, for a period during which said paper is fed in said direction a second predetermined distance that is no greater than said first predetermined distance.

4. A printer according to claim 3, further comprising an indicating device, said central processing unit comprising means for energizing said indicating device in response to sensing of the absence of paper at said position, by said sensor, for a period during which said paper is fed in said direction a second predetermined distance that is less than or equal to said first predetermined distance.

* * * * *